US006700501B2

(12) United States Patent
Winton

(10) Patent No.: US 6,700,501 B2
(45) Date of Patent: Mar. 2, 2004

(54) ALARM SYSTEM

(76) Inventor: Betty Winton, Box 53702, Lubbock, TX (US) 79453

( * ) Notice: Subject to any disclaimer, the term of this patent is extended or adjusted under 35 U.S.C. 154(b) by 0 days.

(21) Appl. No.: 09/683,058

(22) Filed: Nov. 13, 2001

(65) Prior Publication Data

US 2003/0090378 A1 May 15, 2003

(51) Int. Cl.[7] ..... G08B 21/00
(52) U.S. Cl. ..... 340/687; 340/571; 340/568.1
(58) Field of Search ..... 340/687, 571, 340/568.1, 644; 439/92

(56) References Cited

U.S. PATENT DOCUMENTS 3,781,857 A * 12/1973 Stendig et al. ..... 340/521
4,037,223 A * 7/1977 Tucci et al. ..... 340/571
4,157,542 A * 6/1979 Smith ..... 340/568
4,195,290 A * 3/1980 Magil et al. ..... 340/687
4,390,868 A * 6/1983 Garwin ..... 340/568.1
5,418,521 A * 5/1995 Read ..... 340/568.3
5,434,558 A * 7/1995 Zeder ..... 340/568
5,641,292 A * 6/1997 Fann ..... 439/103
5,714,942 A * 2/1998 Buchanan ..... 340/686
6,150,940 A * 11/2000 Chapman et al. ..... 340/568.3
6,462,668 B1 * 10/2002 Foseide ..... 340/687

* cited by examiner

*Primary Examiner*—Daniel J. Wu
*Assistant Examiner*—Phung Nguyen
(74) *Attorney, Agent, or Firm*—Pillsbury Winthrop LLP

(57) ABSTRACT

The present invention is a device designed to sound an alarm when it is removed from an electrical outlet. The device is plugged into an electrical outlet using a set of prongs like those used in the electrical plugs of typical household appliances. When the device is in its activated state, its being removed from the outlet will cause an alarm to sound, thereby alerting persons in the area. The apparatus is battery-powered, and does not form a circuit with the outlet into which it is inserted.

15 Claims, 1 Drawing Sheet

ALARM SYSTEM

BACKGROUND OF INVENTION

Children are inquisitive by nature. Any parent or teacher knows that children are liable to work their way into even the most apparently inaccessible location. This is a natural and healthy part of childhood. Unfortunately, young children are inexperienced and so are often incapable of recognizing dangerous objects or activities that would be clearly recognized as such by an adult. This leads to the unfortunate result that children sometimes attempt to do things that are hazardous, or even life threatening, and occasionally succeed in the task. Accordingly, parents or other guardians are obliged to keep a close watch over young children at all times so as to ensure that they will stay out of harm's way.

Unfortunately, not even the most vigilant person can keep an eye on a child at all times. Parents and other guardians simply have too many things to do to be able to always have the child in their sight. In addition, a guardian often must monitor the activities of multiple children, not all of whom are necessarily in the same location. Accordingly, children often do have opportunities to engage in dangerous behavior when relatively unsupervised.

One object found in the typical home, notorious for its seeming allure and danger to children, is the common electrical outlet. Children are famously fond of attempting to insert their fingers or small objects into the receptacles of such outlets. Moreover, it is usually quite simple for them to do so, as the outlets are typically placed close to the ground and so are in easy reach of even the smallest child. In addition, being at about the eye level of a crawling child, they easily become objects of his or her interest.

It is obvious that a child succeeding in inserting an object into an electrical outlet can lead to undesirable consequences. Once the object, if conductive, makes contact with the wiring inside the outlet, an electrical circuit will be formed and electricity will race along the object, through the child's body, and into the ground. This results in the electrocution of the child. Usually the effect is not lethal. However, it is certainly quite painful, and certainly not beneficial to the child's health.

The present invention provides means to alert a parent or other guardian to the fact that an outlet is about to be accessed. This will hopefully give the person sufficient warning to be able to interrupt the child and prevent the child from doing harm to themselves. There are some current patents that feature alarm systems, regarding appliances or electrical currents but do not meet the specific needs of the present invention.

U.S. Pat. No. 3,090,948, issued to Cremer on May 21, 1963, describes an alarm system in which the plug to an electrical appliance sets off an alarm when unplugged from the outlet. This device is intended to prevent theft of the appliance.

U.S. Pat. No. 3,411,150, issued to Schulein on Nov. 12, 1968, describes an alarm that also activates when an appliance is unplugged from an outlet, but is enclosed in the outlets it monitors. The outlet has amplifiers wired in the interior to set off an alarm if appliances are cut from the outlet. Schulein's invention is intended to monitor many outlets, as in a hotel, or other high risk location, at one time.

U.S. Pat. No. 3,289,194, issued to King on Nov. 26, 1966, relates to an alarm designed to sound when an appliance is severed or otherwise detached from its power source. The alarm is activated when the device loses power and not, as is the case with the present invention, when it is physically removed from an electrical outlet. In addition, it is designed to be specific to appliance theft in its application.

U.S. Pat. No. 3,781,857 issued to Stendig, et al., on Dec. 25, 1973 shows condition responsive receptacles. Stendig's invention is unlike the present invention because it is an electric outlet mechanism with a plug arm, not an alarm system. Stendig's invention is not a device to protect children from exposed outlets, and has no method of warning a caregiver of a child tampering with an outlet.

U.S. Pat. No. 4,037,223 issued to Tucci, et al., on Jul. 19, 1977 shows an audible alarm system for electrical outlets. Tucci's invention is unlike the present invention because it has an opening door on the front, and a child could open Tucci's invention and disable it by removing the standard battery. Instead in the present invention the child would have to remove the backing, which would sound the alarm, once removed from the outlet, alerting the caregiver of the tampering.

U.S. Pat. No. 4,097,843 issued to Basile on Jun. 27, 1978 shows a warning device and receptacle adapter. Basile's invention is unlike the present invention because it is a warning system for alerting the user if an appliance becomes unplugged or if the power source to the appliance has been interrupted. Basile's invention does not provide a means for alerting a caregiver of an open outlet, and is connected to the affected appliance and not to the outlet when an appliance is not applied.

U.S. Pat. No. 4,584,570 issued to Dotson on Apr. 22, 1986 shows an electrical appliance plug removal alarm. Dotson's invention is unlike the present invention because it is a disc used to place between the appliance plug and the outlet, when the appliance is unplugged the disc will trip the circuit breaker to that plug. Dotson's invention is intended to protect hotels from appliance theft. Dotson's invention is unlike the present invention because it is only activated when an electrical plug is pulled from an outlet, or if the cord to the appliance is cut. It does not cover unused outlets, and has no audible alarm included to alert a caregiver that the outlet is open and available to the child.

U.S. Pat. No. 4,855,719 issued to Posey on Aug. 8, 1989 shows an electrical receptacle alarm switch. Posey's invention is unlike the present invention because it is an alarm system for alerting a user when an appliance has been unplugged. Posey's invention relies on a three-prong plug to an electrical appliance to be inserted into an outlet equipped with the alarm system. It does not provide an external alarm cover for outlets that can be accessible to children, and would not function in a two-prong outlet.

U.S. Pat. No. 5,162,793, issued to Plost et al. on Nov. 10, 1992, is relevant to an electrically powered alarm system designed to go off when a plug is removed from an aperture. However, the invention in question is to be used in drain plugs used in watercraft, and not in an electrical outlet.

U.S. Pat. No. 5,714,942 issued to Buchanan on Feb. 3, 1998 shows an alarm system for indicating the removal of plug from a receptacle. Buchanan's invention is unlike the present invention because it is a plate mechanism for protecting both outlets in a receptacle and does not have a mechanism for protecting one outlet at a time. Buchanan's invention requires covering both outlets to function, whereas the present invention allows a caregiver to cover only one outlet in a receptacle if the other is in use.

Previous patents are also existent which disclose protective covers or shields of various sorts for electrical outlets.

Examples of this are: U.S. Design Pat. No. 267,226, issued to Oster on Dec. 14, 1982; U.S. Design Pat. No. 279,860, issued to Schwalbe on Jul. 30, 1985; and U.S. Design Pat. No. 310,320, issued to Domian on Sep. 4, 1990. None of these patents describe outlet plugs designed to sound a warning when removed from an electrical outlet. Indeed, none utilize electrical power in any way whatsoever.

U.S. Pat. No. 4,484,185, issued to Graves on Nov. 20, 1984, describes a plug adapter designed to make electrical outlets virtually inaccessible to small children. It does not, however, feature an audible alarm as a component element.

There also exist patents describing alarm systems of a more general sort. Examples of this include: U.S. Pat. No. 5,652,568, issued to Ko on Jul. 29, 1997; Japanese Patent No. 64-229,423, issued to Saito on Apr. 4, 1991; and Japanese Patent No. 4-111,624, issued to Tazume on Nov. 19,1993. None of these devices are triggered when a device is removed from an electrical outlet.

Therefore, a need has been established for an alarm system for outlets which alerts a caregiver if a child reaches the outlet and removes the alarm system.

SUMMARY OF INVENTION

The present device is a small apparatus, housed in a plastic shell, designed to be inserted into an electrical outlet using a set of prongs like those found on the electrical cords with which household appliances are typically equipped. An alarm apparatus is designed to sound when the device is removed from an electrical outlet. The apparatus is powered using internal batteries, and does not form a circuit with the electrical outlet into which it is inserted. The device is equipped with a conventional two-prong system for insertion into the electrical outlet. One of the prongs is hinged to aid in alarm initialization. Internally there is a conventional spring, which provides constant pressure when the device is inserted into the outlet. When the device is removed from the outlet, the spring causes the hinged prong to swing outward. This movement of the hinged prong activates an internal switch and completes the circuit between the battery and the alarm component. The alarm will continue to sound until the circuit is broken by the hinged prong returning to its originating position.

DETAILED DESCRIPTION

Figure 1:
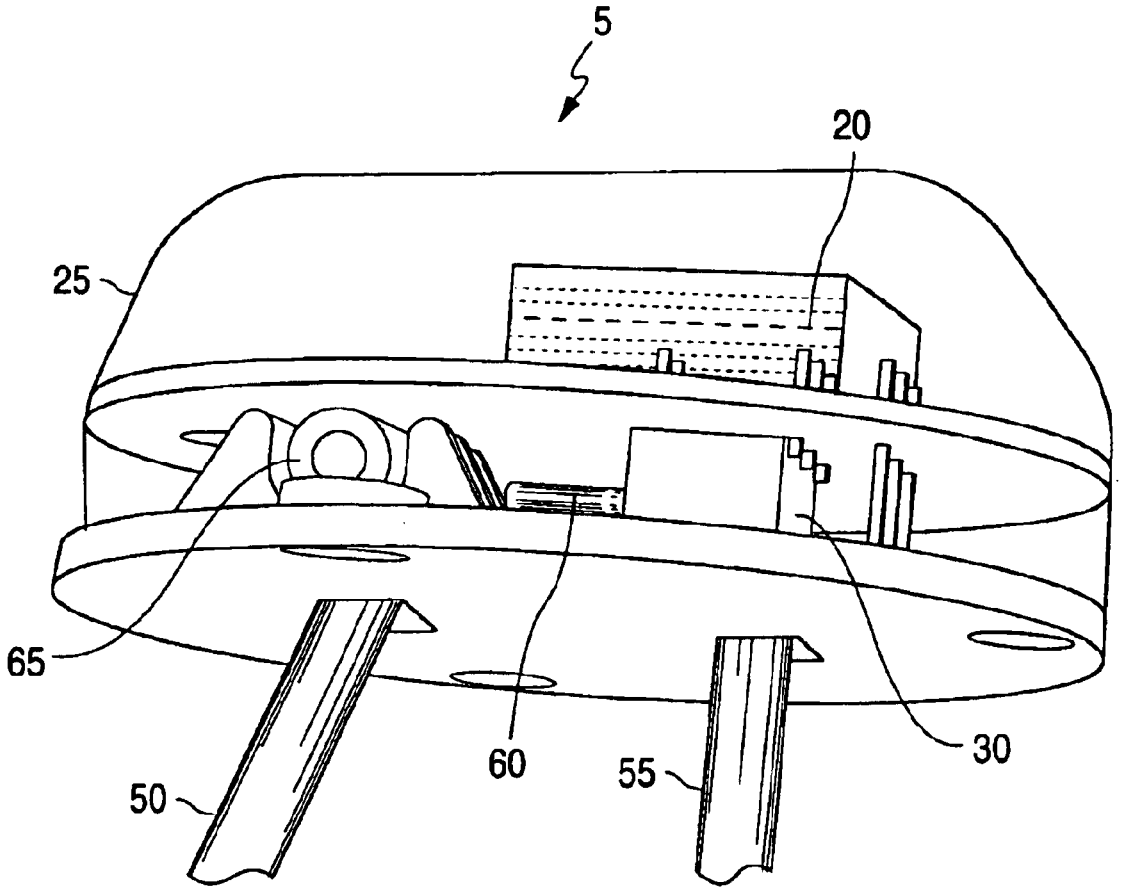
FIG. 1 displays a side view of the present invention.

As shown in FIG. 1, the present invention (5) is slightly larger than the front of a normal electrical outlet. The alarm (5) fully covers and restricts access to the electrical outlet (not shown). However the present invention is small and entirely portable, making use easy for caregivers even in hotels upon travel. It exhibits a two-prong insertion system (50, 55) not unlike conventional cords and plug in systems, found on appliances in use today. One of the prongs (50) is hinged so that it can be both fully extended to enter the electrical outlet (not shown), and upon removal from the outlet pressure from the spring (65) will cause the hinged prong (50) to swing outward. This action causes the angled portion of the hinged prong to rotate, releasing the pressure on the plunger (60) of switch (30). This completes the circuit between battery (not shown) and alarm, causing the device to emit a loud noise. The case (25) and prongs (50,55) are fashioned to fit standard 110–120 wall receptacles as used in the United States, but can be fashioned to fit outlets in other parts of the world. Although the present invention (5) is intended to be plugged into a standard electrical outlet, it does not rely upon said outlet for power. As it is an object of this invention to alert caregivers of unprotected electrical outlets, it would not be sensible to rely upon the device being plugged into the wall to function.

Enclosed in the plastic casing (25) of the present invention (5) is a space for one long lasting battery (not shown). The long lasting battery (not shown) upon depletion can be removed by removing the backing of the present invention with a screw driver, and inserting a new battery (not shown). This provides the independent power source for the present invention (5), making it effective upon removal from the outlet. This battery (not shown), separate from the household circuit eliminates the need for outside power and the potential for false alarms due to power outage. When the present invention (5) is removed from the outlet, the alarm (20) emits a sound alerting caregivers of open access to the electrical outlet. The present invention (5) will enable the parent or guardian to monitor the activities of the child when they are not present in the same room. The present invention (5) would be especially useful to visually impaired parents who cannot see that the child is close to electrical shock, but could easily react to the sound of the alarm (20). This sound may provide the warning that the child needs in order to not insert the item or body part into the outlet, possibly electrocuting themselves.

Children develop aural abilities that facilitate their learning at a young age. Often loud noises deter children from participating in activities that may be fun for older children, but scare younger children. For example, at a movie theater, school age children seem to enjoy the loud surround sound effects of movies, however toddlers and preschoolers often react in fear to the noise. In this same aspect these small children may be startled and thus deterred by the noise of the alarm allowing parents or caregivers a chance to get to them and remove them from the hazardous situation.

The exterior casing (25) protects the internal components from damage and from contact with humans and pets. Also as a part of the casing (25) is the watch alarm (20), which will sound upon removal of the device from the outlet.

Primarily, the present invention (5) is an alarm (20) to warn adults that a child, or person in their care is in the process of accessing a live electrical outlet, but is not limited exclusively, thereto. It is to be understood that the present invention (5) is not limited to the sole embodiment described above, but encompasses any and all embodiments within the scope of the following claims.

What is claimed is:

1. An alarm for electrical outlets; said alarm comprising:

a two pronged insertion system comprising a fixed prong and a movable prong;

a switch, in communication with said two pronged insertion system; and a warning system, in communication with said switch; said warning system comprising:

a circuit activated responsive to operation of said switch;

a battery operative to power said circuit; and an alert component operative to activate an audible alarm when said two pronged insertion system is not engaged in an electrical outlet;

wherein said movable prong activates said audible alarm upon removal of said two pronged insertion system from an electrical outlet.

2. The alarm of claim 1, wherein the alarm fits over one receptacle in an electrical outlet.

3. The alarm of claim 1, wherein said movable prong moves away from said fixed prong to activate said audible alarm.

4. The alarm of claim 1, wherein the alarm fits over two receptacles in an electrical outlet.

5. The alarm of claim 1, wherein said movable prong moves toward said fixed prong to activate said audible alarm.

6. The alarm of claim 1, wherein said movable prong is coupled to said switch with a hinge.

7. The alarm of claim 1, wherein said movable prong is slidable relative to said switch.

8. An alarm for electrical outlets; said alarm comprising:

a two pronged insertion system comprising a fixed prong and a movable prong;

a switch, in communication with said two pronged insertion system and comprising an internal trigger piece operably coupled to said movable prong; and a warning system, in communication with said switch;

wherein said movable prong is spring-biased relative to said trigger piece and said movable prong activates an alert component when said two pronged insertion system is removed from an electrical outlet.

9. The alarm of claim 8, wherein the alarm fits over one receptacle in an electrical outlet.

10. The alarm of claim 8, wherein the alarm fits over two receptacles in an electrical outlet.

11. The alarm of claim 8, wherein said movable prong moves away from said fixed prong to activate said alert component.

12. The alarm of claim 8, wherein said movable prong moves toward said fixed prong to activate said alert component.

13. The alarm of claim 8, wherein said movable prong is coupled to said trigger piece with a hinge.

14. The alarm of claim 8, wherein said movable prong is slidable relative to said trigger piece.

15. The alarm of claim 8, wherein said alert component comprises an audible alarm activated by movement of said movable prong.

* * * * *